US009701453B2

(12) United States Patent
Moradi

(10) Patent No.: US 9,701,453 B2
(45) Date of Patent: Jul. 11, 2017

(54) CLOSURE CAP FOR ATTACHING TO A LIQUID CONTAINER

(71) Applicant: Moradi Consulting GmbH, Vienna (AT)

(72) Inventor: Shahriar Moradi, Hagenbrunn (AT)

(73) Assignee: Moradi Consulting GmbH, Vienna (AT)

( * ) Notice: Subject to any disclaimer, the term of this patent is extended or adjusted under 35 U.S.C. 154(b) by 0 days.

(21) Appl. No.: 14/889,999

(22) PCT Filed: Jul. 18, 2014

(86) PCT No.: PCT/EP2014/065516
§ 371 (c)(1),
(2) Date: Nov. 9, 2015

(87) PCT Pub. No.: WO2015/188893
PCT Pub. Date: Dec. 17, 2015

(65) Prior Publication Data

US 2016/0167852 A1 Jun. 16, 2016

(51) Int. Cl.
*B65D 51/28* (2006.01)
*A45F 3/16* (2006.01)
(Continued)

(52) U.S. Cl.
CPC ..... *B65D 51/2807* (2013.01); *A45F 3/16* (2013.01); *B65D 47/06* (2013.01); *B65D 47/283* (2013.01)

(58) Field of Classification Search
CPC .. B65D 51/2807; B65D 47/06; B65D 47/283; B65D 43/12; B65D 43/20; B65D 51/18;
(Continued)

(56) References Cited

U.S. PATENT DOCUMENTS 8,083,055 B2 * 12/2011 Simonian ..... B65D 47/243 206/221
8,297,456 B1 * 10/2012 Anderson ..... B65D 51/222 206/222

(Continued)

FOREIGN PATENT DOCUMENTS

WO 2011/149501 A1 12/2011
WO 2015/039709 A1 3/2015

OTHER PUBLICATIONS

International Search Report of PCT/EP2014/065516, mailed Mar. 12, 2015.

*Primary Examiner* — Robert J Hicks
*Assistant Examiner* — Kareen Thomas
(74) *Attorney, Agent, or Firm* — Collard & Roe, P.C.

(57) ABSTRACT

The invention relates to a closure cap for attaching to a liquid container, wherein the closure cap comprises a spout opening (11) and a receiving element (8), which together with the closure cap forms a common receiving volume for receiving at least one dispensing body, and the closure cap can be opened, thus forming an entrance (2) to the receiving volume (20) in order to enable the introduction of the at least one dispensing body into the receiving volume, wherein the receiving element (8) is permeable to a liquid in order to allow the at least one dispensing body to come into contact with the liquid, wherein a closure element (1) connected to the closure cap is provided, by means of which the entrance (2) can be sealed in a liquid-tight manner.

In order to prevent the entrance of liquid into the receiving volume when no drinking process occurs, a mouthpiece (7) formed as a hollow body is arranged in the spout opening (11), which mouthpiece seals the receiving element (8) in a liquid-tight manner in a closed position and opens the
(Continued)

receiving element (8) in an open position, so that liquid can flow through the receiving element (8), the receiving volume (20) and the mouthpiece (7).

17 Claims, 2 Drawing Sheets

(51) Int. Cl.
*B65D 47/28* (2006.01)
*B65D 47/06* (2006.01)

(58) Field of Classification Search
CPC ..... B65D 47/286; B65D 47/28; B65D 47/26; A45F 3/16
USPC ..... 220/256.1, 257.1, 258.1, 254.1–254.9, 220/345.6, 345.1, 259.5; 215/227; 222/561, 559
See application file for complete search history.

(56) References Cited

U.S. PATENT DOCUMENTS

| | | | | |
|---|---|---|---|---|
| 8,672,156 | B2 * | 3/2014 | Martinovic | B65D 51/18 215/227 |
| 8,701,906 | B1 * | 4/2014 | Anderson | B65D 41/20 206/220 |
| 9,051,100 | B2 * | 6/2015 | Suzuki | B65D 51/2871 |
| 2010/0012193 | A1 | 1/2010 | Anson et al. | |
| 2011/0204060 | A1 * | 8/2011 | Suzuki | B65D 51/2871 220/521 |

* cited by examiner

CLOSURE CAP FOR ATTACHING TO A LIQUID CONTAINER

CROSS REFERENCE TO RELATED APPLICATIONS

This application is the National Stage of PCT/EP2014/065516 filed on Jul. 18, 2014, the disclosure of which is incorporated by reference. The international application under PCT article 21(2) was not published in English.

BACKGROUND OF THE INVENTION

The present invention relates to a closure cap, preferably a screw cap, for attaching to a liquid container, preferably a bottle, more preferably a PET bottle, wherein the closure cap comprises a spout opening, preferably a reclosable spout opening, and a receiving element, which together with the closure cap forms a common receiving volume for receiving at least one dispensing body, e.g. at least one tablet, and the closure cap can be opened, thus forming an entrance to the receiving volume in order to enable the introduction of the at least one dispensing body into the receiving volume or the removal of said body from the receiving volume, wherein the receiving element is permeable to a liquid in order to allow the at least one dispensing body to come into contact with the liquid, wherein a closure element connected to the closure cap is provided, by means of which the entrance can be sealed in a liquid-tight manner or released.

DESCRIPTION OF THE PRIOR ART

In order to enable the intake of liquid on the road or during sports, drinking bottles are known, especially drinking bottles with a closure cap. The drinking bottles usually comprise a thread onto which the closure caps are screwed. The threads are standardized and the number of the different standardized threads of said drinking bottles is low. These bottles can be prefilled on the one hand, e.g. with mineral water, which can also be mixed with flavors, or with an isotonic beverage. On the other hand, bottles can be concerned which are designated to receive a liquid mixed by the user as required. In this case, effervescent powders in powder form or tablet form are available in addition to fruit juice syrups.

It is disadvantageous in both cases that the user is fixed to the specific beverage mixture for the entire duration of use of the beverage, i.e. between the start and the end of the consumption of the beverage, which means the user can no longer change the flavor during the consumption of the beverage, because the liquid still contained in the bottle only comprises the flavor selected beforehand.

However, not only the desire for a specific flavor can change during the start and the end of the consumption of the beverage. If the user has decided on a non-isotonic beverage for example and wishes to have an isotonic beverage after a specific period of time in which the user has practiced sports, this is also no longer possible with the liquid still present in the bottle.

Incomplete dissolution of conventional effervescent powder can be caused by sub-optimal dosing, especially an excessive concentration of the effervescent powder or tablets. Maintaining the correct dosage is usually not always easy because the specifically existing quantity of liquid needs to be considered in mixing the powder or the tablet with the liquid, which is usually water.

These disadvantages can be remedied at least in part according to US2010/0012193A1. It describes a liquid container with a closure cap which is formed in three parts, i.e. a tablet container, a container lid and a closure cap closure. The container lid must be screwed off and subsequently screwed on again for the insertion of a tablet into the tablet container. It is disadvantageous that the container lid can be dropped or lost.

A closure cap, preferably a screw cap, is shown in PCT/EP2013/071276 for the attachment to a liquid container, preferably a bottle, more preferably a PET bottle, wherein the closure cap comprises a spout opening, preferably a reclosable spout opening, and a receiving element, which together with the closure cap forms a common receiving volume for receiving at least one dispensing body, and the closure cap can be opened, thus forming entrance to the receiving volume in order to enable the introduction of at least one dispensing body into the receiving volume or the removal of said body from the receiving volume, wherein the receiving element is permeable to a liquid in order to allow the at least one dispensing body to come into contact with the liquid. A closure element connected to the closure cap is provided, by means of which the entrance can be sealed in a liquid-tight manner or released. This allows the mixing of flavors and/or nutrients and/or dietary supplements and/or medical compounds into a liquid that can be received in the liquid container by avoiding the aforementioned disadvantages. A closure cap can be provided for each of the low number of different standardized types of threads, so that any type of bottle can be used with the low number of closure caps. When inserting a dispensing body, no part of the closure cap or the closure cap per se is lost or will drop. The closure cap is characterized by simple handling, which allows simple changing of the flavors and/or nutrients and/or dietary supplements. Partially dissolved dispensing bodies can be removed from the bottle with the closure cap again. Dosing problems are avoided, especially excessive concentrations of flavors and/nutrients and/or dietary supplements in the liquid.

Since the closure cap shown in PCT/EP2013/071276 has a receiving volume which—when the closure cap is attached to the liquid container—is open toward the liquid container, like toward a bottle, it may occur that when the bottle is situated horizontally liquid can enter the receiving volume from the bottle and dissolve the dispensing body.

OBJECT OF THE INVENTION

It is therefore an object of the present invention to provide a closure cap for liquid containers which prevents the entry of liquid into the receiving volume when no drinking process occurs.

SUMMARY OF THE INVENTION

This object is achieved by a closure cap, preferably a screw cap, for attaching to a liquid container, preferably a bottle, more preferably a PET bottle, wherein the closure cap comprises a spout opening, preferably a reclosable spout opening, and a receiving element, which together with the closure cap forms a common receiving volume for receiving at least one dispensing body, e.g. at least one tablet, and the closure cap can be opened, thus forming an entrance to the receiving volume in order to enable the introduction of at least one dispensing body into the receiving volume or the removal of said body from the receiving volume, wherein the receiving element is permeable to a liquid in order to allow the at least one dispensing body to come into contact with the liquid, wherein a closure element connected to the closure cap is provided, by means of which the entrance can be sealed in a liquid-tight manner or released. It is provided in accordance with the invention that a mouthpiece formed as a hollow body is formed in the spout opening, which mouthpiece seals the receiving element in a liquid-tight manner in a closed position, so that no liquid can flow through the receiving element into the receiving volume, and opens the receiving element in an open position, so that liquid can flow through the receiving element, the receiving volume and the mouthpiece (out of the mouthpiece).

The mouthpiece is thus used on the one hand in the open position for withdrawing liquid from the closure cap, and it is used on the other hand in the closed position to seal the receiving volume and a liquid-soluble dispensing body situated therein against the liquid container to which the closure cap is attached.

The closure cap preferably concerns a screw cap which fits all standardized water bottles, or it is possible to use the low number of differently standardized types of bottle threads with the low number of different closure caps. The closure cap is provided with a mouthpiece which seals the spout opening of the closure cap and can be transferred from a closure position or closed position to a release position or open position, preferably by displacing the mouthpiece.

It has been recognized that the closure element represents a simple and quick possibility to position a receiving body in the receiving volume or to remove it therefrom. The connection ensures that the closure element is unable to drop inadvertently. The user therefore will not have to worry where to place the closure element while the closure cap is open. Furthermore, the unpleasant situation that the closure element will drop on the floor and will thus become dirty can thus be prevented. The closure element can be arranged as the upper part of the closure cap for example which is simply folded away, or also as a door which is folded laterally. The various possibilities for configuration have in common that they offer simple and rapid access to the receiving volume and the dispensing body can thus be changed, introduced or removed in a rapid and simple way.

The opening and especially the closing of the closure element can be provided in a simple and rapid manner without having to concentrate on the process.

It can be provided that the mouthpiece is closed on the side facing the receiving element (especially in the region where the mouthpiece engages in the receiving element), so that in the closed state of the mouthpiece no liquid can reach the mouthpiece through the receiving element, and in another section with which it protrudes into the receiving volume it comprises at least one opening through which the liquid can flow from the receiving volume to the mouthpiece.

In the closed position, liquid is thus unable to flow from the liquid container via the mouthpiece and through the closure cap. In the closed position, the secure storage of the liquid in the liquid container is provided with the closure cap in accordance with the invention, even if it is transported or carried along by the user during sports activities, without the dispensing body coming into contact with the liquid from the liquid container. Liquid is only able to pass through the receiving volume and the closure cap via the mouthpiece in the open position, as a result of which the dispensing body is dissolved (further) and the user is allowed to drink.

In one embodiment, the mouthpiece can be displaceable relative to the receiving element along a sliding axis. The sliding axis can be parallel to the longitudinal axis of the closure cap or the liquid container (of the bottle).

A baffle plate can be provided in the receiving volume, which plate surrounds the mouthpiece at least in part and which is located closer to the receiving element than an opening of the mouthpiece through which liquid can reach the mouthpiece from the receiving volume when the mouthpiece is situated in the open position.

It is thus ensured that a liquid which flows from the liquid container to the closure cap does not flow directly to the opening of the mouthpiece and thus might not flow around the dispensing body situated in the receiving volume. The liquid needs to flow around the baffle plate and therefore must take a longer path through the receiving volume in order to reach the mouthpiece again and will thus also flow around the dispensing body and dissolve the same at least in part. The baffle plate can be arranged perpendicularly to the sliding axis of the mouthpiece for example. The baffle plate can be arranged in the simplest of cases as a flat plate. It can principally protrude to any extent into the receiving volume. The dispensing body may come to lie on the baffle plate. The dispensing body could also be adjusted to the shape of the baffle plate, as it would also usually be adjusted to the shape of the receiving volume.

In order to protrude as little as possible into the receiving volume and thus to take as little space as possible from the dispensing body, it can be provided that the mouthpiece is arranged at the edge of the receiving volume. For example, the mouthpiece could be shifted directly to the jacket surface of the closure cap. The mouthpiece can principally be positioned at will, even centrally in the closure cap.

The receiving element is preferably arranged as a flat surface. This represents an especially simple and thus inexpensive embodiment.

The receiving element is usually entirely situated in a volume formed by the closure cap. This means the volume that is bounded on the one hand by the closure cap and on the other hand by an imagined surface area which is bounded on its part by an edge of the closure cap. Said imagined surface area is actually free from material in order to connect the closure cap with the liquid container, especially in order to enable it to be screwed onto said container. This means that in this case contact of the closure cap only occurs during twisting of the bottle, as performed by the user during the drinking process.

The closure element is pivotable in a further embodiment of the closure cap in accordance with the invention. It has been recognized that the pivotable closure element represents a simple and rapid possibility to position a dispensing body in the receiving volume or to remove it therefrom. The term pivotable shall be understood in such a way that the closure element (a part thereof since the closure element remains connected to the closure cap) is detached from the closure cap and thus can be removed at least in part to such an extent that the resulting opening allows access to the receiving volume in order to place a dispensing body in the receiving volume or to remove it therefrom. Pivotable therefore means that the closure element can be deflected from the position closing the entrance in order to introduce a dispensing body for example without the closure element dropping off, and can subsequently be brought back to the position closing the entrance in a simple way.

In a further embodiment of the closure cap in accordance with the invention, the closure element is connected by means of a hinge-like connecting element. The hinge-like connecting element can be a thin web or one or several fixed hinges or a flexible plastic piece or any other suitable element. A hinge not only allows simple opening of the entrance to the receiving volume, but also offers a guide during closing which allows the user to not concentrate on the closing because the movement is guided by the hinges and it is merely necessary to apply an externally acting force in order to properly close the entrance. The user therefore need not take particular care how the entrance is closed, or that the user needs to position the closure element in a specific manner on the other part of the closure cap.

In an embodiment of the closure cap in accordance with the invention, the closure element is formed as a part of the jacket surface of the closure cap, wherein it seals the entrance in the operating position. The closure element can be formed as a flap, which can be folded laterally, upwardly or downwardly. This represents a simple and elegant solution because it prevents the liquid from flowing out at the position of the closure element in the closed state of the closure element and offers access to the receiving volume in the open state in order to enable the rapid and simple positioning of a dispensing body, wherein unintended opening by specific situations is prevented.

The force required for this purpose is preferably calculated in such a way that the mouthpiece is not inadvertently opened by rubbing of other objects on the closure cap in a bag for example. This fact leads to the consequence however that closure elements opening in the upward direction can inadvertently be opened by said upward pull on the mouthpiece, which is prevented in the embodiment of the closure element as a part of the jacket surface.

In a further embodiment of the closure cap in accordance with the invention, the closure cap comprises two parts, wherein the first part comprises the thread for fastening to a liquid container and the second part comprises the spout opening, and the second part forms the closure element. As a result of the two-part configuration, it is especially simple to position a dispensing body on the receiving element. It is possible that the transition from the first part to the second part represents a horizontal division of the closure cap. In an especially simple embodiment of the closure cap, the closure cap is formed cylindrically in the region of the transition. This represents a simple and thus also inexpensive embodiment.

An especially simple and comfortable filling of the receiving volume can be realized in that the closure cap comprises an extractable storage element for the dispensing body, which storage element corresponds to the entrance and the receiving volume and which can be introduced through the open entrance into the receiving volume and can be positioned on the receiving element, which means for filling the receiving volume the storage element is pulled from the open entrance, at least one dispensing body is placed in the receiving element, and the storage element is thus pushed into the receiving volume again via the open entrance. It is further advantageous with respect to this embodiment that dispensing bodies which have already partly been dissolved in the receiving volume can be removed more easily again for example.

In a further embodiment of the closure cap in accordance with the invention, the second part comprises on its jacket surface a local deformation facing inwardly in the radial direction of the closure cap, as a result of which a pressure is exerted in the operating position by the local deformation on the first part and the two parts are mutually clamped against each other. The deformation faces inwardly in the radial direction of the cylindrical receiving volume. It is thus prevented that the closure part is not additionally opened inadvertently in the case of closure caps with a mouthpiece which release the opening on the mouthpiece for drinking through a strong pull on the mouthpiece.

The preferred embodiment of the closure element is that it is formed as a slide which is displaceable along the jacket surface of the closure cap. The slide can be displaceable for example in the direction parallel to the longitudinal axis of the closure cap or normally to the longitudinal axis in the circumferential direction of the closure cap. The slide can substantially correspond to a rectangular section from the jacket surface of the closure cap.

It can be provided in the configuration of the closure element as a slide that the slide is displaceable in relation to the closure cap by using a profile rail. One or several profile rails can thus be provided in the slide on opposite sides (e.g. on or close to longitudinal edges or transverse edges) per side, which profile rails extend in parallel with respect to each other and are guided in depressions of the closure cap with a respective profile. It can conversely be provided that the closure cap comprises at least two profile rails which are parallel with respect to each other outside of the entrance, which profile rails engage in the respective depressions of the closure element. The profile of the profile rail comprises a taper for example in both cases, so that the profile rail cannot be pulled out of the depression normally to its longitudinal extension.

A closure cap is especially preferred where the slide surrounds the entire circumference of the closure cap. This offers the advantage that the slide has tension against deformations as a result of its closed form, which tension allows good sealing of the entrance to the receiving volume. Such a slide can be formed as a cylinder jacket for example. A slide which surrounds the entire circumference of the closure cap can not only be used in closure caps with the mouthpiece in accordance with the invention, but could also be used instead of the slide of PCT/EP2013/071276 which is shown in FIGS. 18 to 23, which only surrounds a portion of the circumference of the closure cap.

The slide can latch into sealing edges of the closure cap in the closed state, which sealing edges extend normally to the sliding axis of the slide. The slide can be made of an elastic material, so that the slide can be slid over the sealing edges, but which seals the entrance in a liquid-tight manner after latching onto the sealing edges.

The sliding axis of the slide and the sliding axis of the mouthpiece can extend in parallel with respect to each other, and they could even be identical.

It can be provided as an alternative embodiment to the closure element as a slide that the closure element can be screwed together by means of a thread with a base part of the closure cap, which allows an especially liquid-tight closure of the entrance of the closure cap. For this purpose, the closure element and the base part have a mutually corresponding thread for this purpose. The base part can comprise a thread on its exterior side for example, while the closure element comprises a matching thread on its inner side. Conversely, the base part could obviously comprise a thread on its inner side, while the closure element carries the thread on its exterior side.

The closure element can be cap-shaped in this embodiment, so that a substantially two-part closure cap is obtained, comprising a base part which is cylindrical for example and which can be connected to a liquid container, and the closure element which seals the closure cap.

The closure element can comprise the spout opening with the mouthpiece, while the base part comprises the receiving element. The base part can further comprise a thread for screwing the closure cap onto a liquid container.

A dispensing body, e.g. in form of a tablet, is provided for receiving in a receiving volume of a closure cap in accordance with the invention in order to ensure simple handling and an optimal dosing possibility when using the closure cap in accordance with the invention.

In order to ensure that the dispensing body can be accommodated in a receiving volume, the dispensing body should have a dispensing body volume which is not greater than the receiving volume.

In order to enable producing a beverage when making contact with liquid or to release flavors and/nutrients and/or dietary supplements and/or medical compounds and thus mix them into liquid, the dispensing body may comprise at least one water-soluble element for producing a beverage and/or for releasing a flavor and/or a nutrient and/or a dietary supplement and/or a medical compound. The nutrients comprise carbohydrates, minerals and vitamins. If several carbohydrates, minerals and vitamins are released, the production of an isotonic beverage is thus possible. If at least one dispensing body is arranged in the receiving volume, the liquid flows around said body during the drinking process and it is able to release substances, especially flavors and/or nutrients and/or dietary supplements and/or medical compounds, to the liquid, which means mixing with the liquid occurs directly before the user actually drinks the mixture. An excessive concentration of the desired substances in the liquid can thus principally be avoided.

Notice must be taken in this respect that after removing the bottle after the drinking process a specific portion of the liquid will generally flow back into the bottle from the receiving volume. A specific proportion of the aforementioned substances can be transferred to the remaining liquid situated in the bottle, which needs to be considered in the configuration of the dispensing body or its dispensing characteristics.

In order to ensure a spatially stable arrangement of the water-soluble elements, which additionally contributes to ensuring that no water-soluble elements can reach through the passage openings of the closure cap, they can be arranged in a sponge for example which fills the dispensing body volume at least in part. The dispensing body can therefore comprise a sponge, preferably a plastic sponge. Said plastic sponge can be formed in such a way that the liquid can easily reach the water-soluble elements, which can be achieved for example by a sponge fabric made of coarsely woven fibers.

In order to further improve handling, the dispensing body can comprise a liquid-permeable net-like fabric, especially gauze, which retains the dispensing body in a dispensing body shape which fits into a receiving volume. The thus stabilized dispensing body shape especially also allows simple and convenient changing of the dispensing body after the drinking process, once the water-soluble elements have already been dissolved entirely or at least partly. Especially good stabilization of the dispensing body shape in combination with simultaneously simple producibility can be achieved in that the net-like fabric is arranged on an exterior side of the dispensing body.

In order to use substantially natural substances for the preparation of the beverage, the at least one water-soluble element can concern a ball arranged in the dispensing body volume, whose surface is formed by a water-soluble layer and whose interior is filled with a substance such as syrup or tea, which contains a flavor and/or a nutrient and/or a dietary supplement and/or a medical compound. The water-soluble layer is formed in this case from a water-soluble icing, especially sugar icing, which contributes to the avoidance of chemicals.

The time progression of the delivery of the substances, especially the flavors and/or the nutrients and/or the dietary supplements and/or the medical compounds can be realized by several balls with different icing layer thicknesses. The balls with the thinnest icing layer thicknesses release the substances first, whereas balls with thicker icing layer thicknesses do not release any substances yet. Only at a later point in time when the substances of the balls with the originally thinner icing layer thickness have been consumed will the balls with the originally thicker icing layer thicknesses release the substances stored in them.

They can concern the same substances for example as before, so that a temporarily constant concentration of these substances is achieved in the liquid. It is also possible to provide different substances in the balls, so that a beverage with fruit flavor is provided at first and an isotonic beverage at a later point in time. This allows athletes to drink different beverages over time by carrying along only one single liquid container, wherein an isotonic beverage is also contained in this case.

Finally, the closure cap in accordance with the invention and the liquid container shall be regarded as a system which allows simple production of beverages or the adding of flavors and/or nutrients and/or dietary supplements and/or medical compounds to a liquid.

BRIEF DESCRIPTION OF THE DRAWINGS

The invention will now be explained in closer detail by reference to embodiments. The drawings are exemplary and are used to explain the inventive concept, but shall not limit or reproduce the same with finality, wherein.

DETAILED DESCRIPTION OF THE PREFERRED EMBODIMENTS

Figures 1, 2, 3, 4, 5, 6, 7, 8:
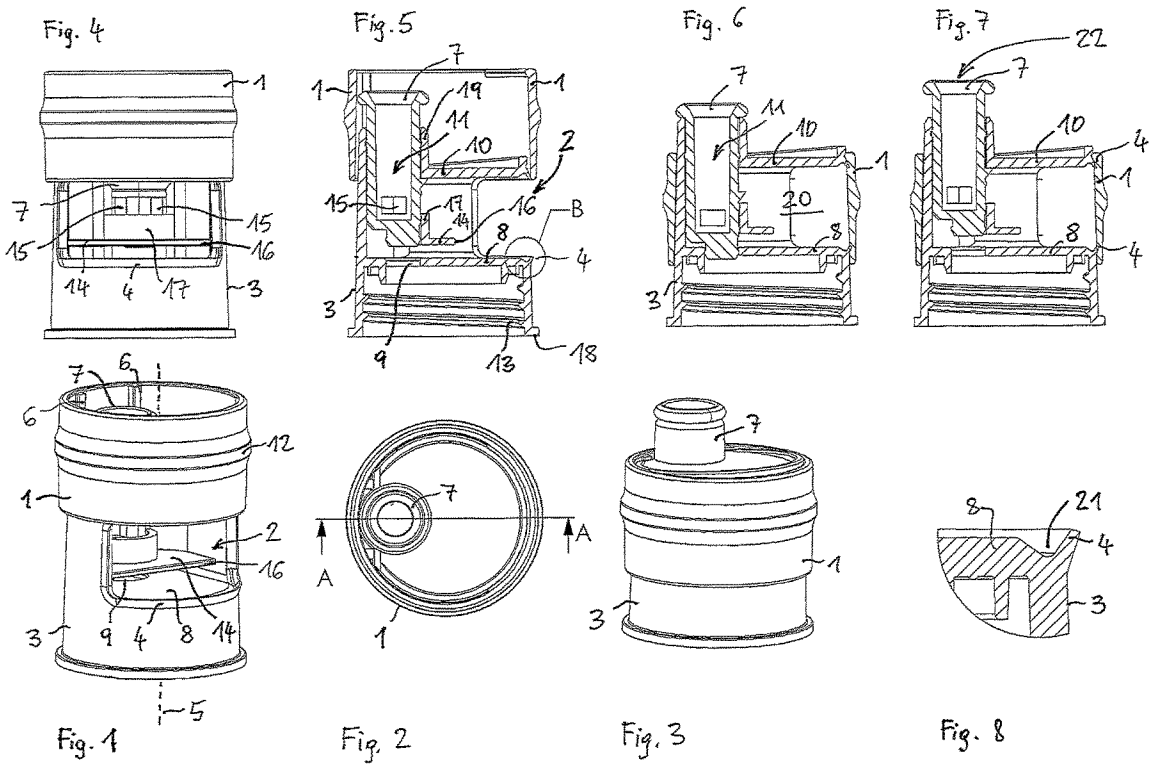
FIG. 1 shows an axonometric view of a closure cap in accordance with the invention with an open closure element (open entrance) which is formed as a slide.
FIG. 2 shows a top view of the closure cap of FIG. 1.
FIG. 3 shows an axonometric view of the closure cap of FIG. 1 with closed closure elements (closed entrance)
FIG. 4 shows a side view of the closure cap of FIG. 1 with an open closure element (open entrance)
FIG. 5 shows a sectional view of the closure cap of FIG. 1 along the line of intersection A-A in FIG. 2 with open closure element (open entrance) and open mouthpiece.
FIG. 6 shows a sectional view according to FIG. 5 with a closed closure element (closed entrance) and closed mouthpiece.
FIG. 7 shows a sectional view according to FIGS. 5 and 6 with closed closure element (closed entrance) and open mouthpiece.
FIG. 8 shows the detail B of FIG. 5 comprising the sealing edge.

FIG. 1 shows a closure cap with an open closure element 1 (open entrance 2), namely a slide. The slide 1 is displaceable along the jacket surface 3 of the closure cap, namely from the illustrated opened position to the open position. It is formed as an annular element, more precisely substantially as a cylinder jacket, and thus surrounds the entire closure cap. It is at least so elastic that it can be slid over the sealing edges 4, but seals the entrance 2 in a liquid-tight manner after latching onto the sealing edges 4. The slide is provided with pretension against radial deformation through the elasticity and the annular configuration, which pretension allows the liquid-tight closure of the entrance 2. FIG. 1 only shows the bottom sealing edge 4, which extends normally to the longitudinal axis 5 in the circumferential direction of the jacket surface 3 at the edge of the entrance 2. The upper sealing edge 4, which also extends normally to the longitudinal axis 5 in the circumferential direction of the jacket surface 3 at the edge of the entrance 2, is covered by the slide 1.

Profile rails 6 are provided on the inner side of the slide 1 for guiding the slide 1 in the direction of the sliding axis which extends parallel to the longitudinal axis 5 of the closure cap, which profile rails interact with counterparts (not shown) on the exterior side of the jacket surface 3 of the closure cap. The profile rails are therefore parallel to the longitudinal axis 5.

The closure cap 1 is provided with a mouthpiece 7, which is shown in FIG. 1 in the open position. In this position, the closure cap is open for a liquid which is accommodated in a bottle to which the closure cap is fixed with its bottom side so as to allow the user to drink from the bottle. By downwardly displacing the mouthpiece 7 parallel to the longitudinal axis 5, the mouthpiece 7 can be brought from the open to a closed position (see FIG. 6). The receiving element 8, which is formed in this case as a flat liquid-tight surface, comprises an opening 9 which can be sealed by the bottom side of the mouthpiece 7, so that no liquid can reach the receiving volume 20 through the receiving element 8 (see FIG. 6).

The receiving element 8 makes contact with the inside wall of the closure cap at least in all points of a circular orbit.

A dispensing body (such as a tablet) can be positioned on the receiving element 8. The closure cap comprises an entrance 2 in order to introduce the at least one dispensing body into the receiving volume 20, or to enable said dispensing body to be removed from the receiving volume 20.

A baffle plate 14 is provided so that liquid flowing from a bottle does not reach the mouthpiece 7 directly through the opening 9, which baffle plate surrounds the mouthpiece 7 at least in part so that liquid entering through the opening 9 needs to flow around said baffle plate 14 and thus through the receiving volume 20 where the dispensing body is located. In this case, the baffle plate 14 reaches approximately to the middle (up to the longitudinal axis 5) of the closure cap and ends in a straight edge 16 which corresponds to the diameter of the receiving volume 20.

The baffle plate 14 is formed in this case normally to the mouthpiece. It is flat and impermeable to liquid. It could also be considered however to provide the baffle plate 14 partly with breakthroughs so that a portion of the liquid also flows through the baffle plate 14. This will be especially useful when the baffle plate 14 covers a major part of the cross-section (normally to the longitudinal axis 5) of the closure cap or the receiving volume 20, because in this case the portion of a dispensing body situated on the baffle plate 14 can be supplied directly from below with liquid.

The slide 1 has a surface structure which is provided in this case in form of elevated rings 12, in order to provide better actuation of the slide 1.

FIG. 2 shows that the mouthpiece 7 is arranged entirely at the edge of the closure cap. This produces the greatest possible contiguous receiving volume for a dispensing body. The mouthpiece 7 can principally also be located at a different place, e.g. closer to the longitudinal axis 5, and especially it could be concentric to the longitudinal axis 5.

In FIG. 3, both the slide 1 is in the closed position and thus closes the entrance 2, as also the mouthpiece 7.

FIG. 4 shows a side view of the closure cap of FIG. 1 with an open slide 1. Two lateral openings 15 can be recognized in the mouthpiece 7, through which liquid reaches the mouthpiece 7 from the receiving volume 20. Said openings 15 should generally be as far away as possible from the edge 16 of the baffle plate 14 so that the liquid flows through the receiving volume to the greatest possible extent before it enters the mouthpiece 7. The guide 17 in the bottom region of the mouthpiece 7 can also be recognized, which guide can be arranged integrally with the baffle plate 14 (see FIGS. 5 to 7).

FIG. 5 shows a sectional view of the closure cap of FIG. 1 along the line of intersection A-A in FIG. 2 with open slide 1 and open mouthpiece 7. The closure cap is provided at its bottom end with a thread 13, between the edge 18 of the closure cap and the receiving element 8, with which it can be screwed onto a bottle.

The sliding axis of the slide 1 and the sliding axis of the mouthpiece 7 extend in parallel with respect to each other and parallel to the longitudinal axis 5 of the closure cap (see FIG. 1.

The receiving volume 20 (also see FIG. 6) has a substantially cylindrical shape. It is formed by the receiving element 8, the jacket of the closure cap (of which the jacket surface 3 is shown), the slide 1 and a cover surface 10 which is connected to the jacket of the closure cap in a liquid-tight manner. The cover surface 10 is liquid-tight apart from the spout opening 11. The cover surface 10 is shown here as a flat layer and further forms a guide 19, which in this case is substantially cylindrical and surrounds the mouthpiece 7 in its upper region.

The receiving element 8 is situated on the side of the closure cap facing the thread 13, while the cover surface 10 is situated on the side of the closure cap facing the mouthpiece 7.

In order to prevent excessive upward sliding of the slide 1, a projection could be provided on the bottom side of the slide 1 which upon reaching the uppermost (open) position of the slide 1 is retained by a respective element of the closure cap.

The mouthpiece 7 is substantially formed as a hollow cylinder which is downwardly sealed towards the receiving element 8, so that no liquid can directly reach the interior of the mouthpiece 7 in the longitudinal direction of the closure cap, irrespective of whether the mouthpiece is in the open or closed position. The bottom side of the mouthpiece 7 is further formed in such a way that in the closed position it closes the opening 9 (which is the only one in this case) in the receiving element. The bottom side of the mouthpiece 7 has a smaller diameter in this embodiment than the remainder of the mouthpiece. In the open position of the mouthpiece 7 according to FIG. 5, the bottom end of the mouthpiece 7 is situated at the same height as the bottom side of the baffle plate 14.

The state shown in FIG. 5 is set when a new dispensing body is placed on the receiving element 8 through the entrance 2 or a (partly) consumed body is to be removed from there.

FIG. 6 shows the same sectional view as FIG. 5, but both the mouthpiece 7 and the slide 1 are in the closed position in FIG. 6. This state of the closure cap is set when the bottle, on which the closure cap is fastened, is transported and no liquid should reach the dispensing body situated in the receiving volume 20.

FIG. 7 shows the same sectional view as FIG. 5, but the mouthpiece 7 is in the open position in FIG. 7, whereas the slide 1 is closed. This state of the closure cap is set when the user drinks from the bottle to which the closure cap is fastened. The liquid would then exit upwardly from the drinking opening 22 of the mouthpiece 7.

FIG. 8 shows the detail B of FIG. 5, namely the formation of the bottom sealing edge 4. The sealing edge 4 which is shown here firstly protrudes radially beyond the adjoining jacket surface 3, and secondly protrudes beyond the upper side of the receiving element 8, and thirdly comprises a depression 21 in relation to the upper side of the receiving element 8 situated on the inside. The upper sealing edge 4 can be formed in an analogous manner, but protrudes in this case beyond the bottom side of the cover surface 10. In the closed state, the slide 1 latches onto the two sealing edges 4 which extend normally to the sliding axis of the slide 1. The slide 1 can comprise respective depressions into which the sealing edges 4 engage.

The jacket of the closure cap (with its jacket surface 3), the receiving element 8, the cover plate 10 and the baffle plate 14 are formed integrally in the illustrated embodiment, e.g. made of plastic, and can be produced by means of injection molding.

It would principally be possible in the illustrated embodiment that the dispensing body is not placed directly through the entrance 2 in the receiving volume 20, but in a removable (e.g. extendable) storage element (similar to a drawer), which is introduced through the entrance 12 into the receiving volume 20 and can also be removed therefrom again. The storage element would come to lie on the receiving element 8. The storage element should obviously be permeable to liquid, e.g. it should have a lattice-like structure at least in part.

It would obviously principally be possible to modify all closure caps shown in PCT/EP2013/071276 in such a way that the relevant mouthpiece can be inserted. In this case, the receiving element should only be permeable to liquid especially in locations where the mouthpiece in accordance with the invention can seal the receiving element. In addition, the cover surfaces in accordance with the invention should optionally take the place of the retaining elements.

FIGS. 9 to 12 show an alternative embodiment of the closure element 23, which can be screwed together with a base part 24 of the closure cap by means of a thread. For this purpose, the closure element 23 comprises a thread 26 on its inner side, while the base part 24 comprises a thread 27 for the closure element 23 on its exterior side. The closure elements 23 is cap-shaped, in that it is formed integrally as a cylinder jacket with a cover surface 10 and a spout opening 11 in the cover surface 10, while the base part 24 has the shape of a cylinder jacket. The base part 24 can be screwed together with the liquid container via the thread 13.

The closure elements 23 carries in the spout opening 11 the mouthpiece 7, while the base part 24 contains the receiving element 8, which is provided in this case in the direction of the longitudinal axis of the closure cap between the thread 13 and the thread 27.

A lid 25 is connected to the closure element 23 via a link, with which the mouthpiece 7 can be covered in so far it protrudes outwardly in the closed state from the closure element 23. The lid 25 can represent a constant extension of the jacket surface 3 in the closed state, i.e. adjoin the exterior surface of the closure element 23. The exterior surface of the closure element 23 converges continuously into the exterior surface of the base part 24, i.e. the closure element 23 and the base part 24 have the same outside diameter at their point of contact.

Figure 10:
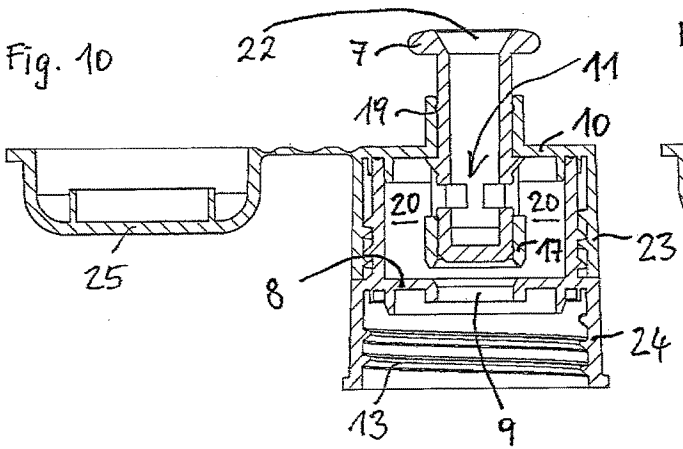
FIG. 10 shows a sectional view of the closure cap of FIG. 9 along the line of intersection A-A in FIG. 12 with open mouthpiece.
Figure 12:
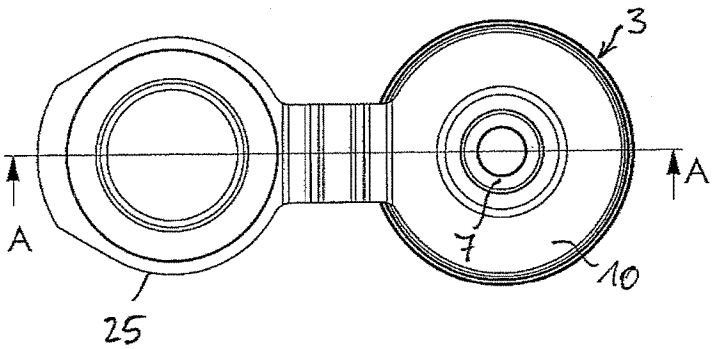
FIG. 12 shows a top view of the closure cap of FIG. 9.
Figure 9:
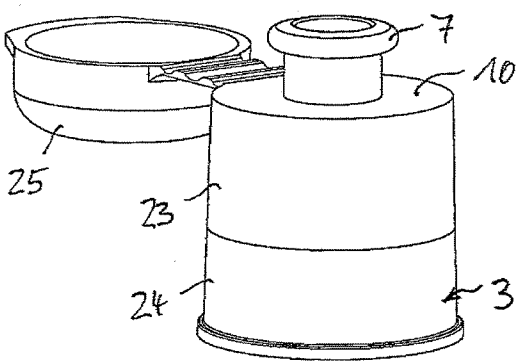
FIG. 9 shows an axonometric view of a closure cap in accordance with the invention with a closure element that can be screwed on (closed entrance)

The mouthpiece 7 is shown in FIG. 10 in the open position. In this position, the closure cap is permeable to a liquid which is accommodated in a bottle, to which the closure cap is fastened with its bottom side, in order to allow the user to drink from the bottle. The mouthpiece 7 can be brought from the open to a closed position by displacing the mouthpiece 7 downwardly parallel to the longitudinal axis 5 (see FIG. 11). The receiving element 8, which is formed in this case as a flat liquid-tight surface, comprises an opening 9 which can be sealed by the bottom side of the mouthpiece 7, so that no liquid can reach the receiving volume 20 through the receiving element 8.

The receiving element 8 makes contact with the inner wall of the closure cap at least in all points of a circular orbit. A dispensing body (e.g. a tablet) can be placed on the receiving element 8. The closure cap comprises an entrance 2 in order to introduce the at least one dispensing body into the receiving volume 20 or to enable the removal thereof from the receiving volume 20. The entrance 2 is formed by the upper opening of the base part 24, i.e. by the end region of the base part 24 facing away from the thread 13, which in this case is a circular opening.

The mouthpiece 7 is arranged centrally in this case, but it could also be arranged at the edge of the closure cap, as shown in FIGS. 1 to 8. The mouthpiece 7 is provided with two openings 15, as otherwise similar to FIGS. 1 to 8. The guide 17 is integrally formed however in the bottom region of the mouthpiece 7 with the closure elements 23 in FIGS. 9 to 12. A baffle plate 14 could also be provided again in the region of the guide 17, especially integrally with the guide 17. It could be formed adjacent to the guide 17 in the manner of a circular ring and normally to the longitudinal axis 5.

The receiving volume 20 again substantially has a cylindrical shape. It is formed by the receiving element 8, the jacket of the base part and the cover surface 10, which is a component of the integral closure element 23. The cover surface 10 is liquid-tight, apart from the spout opening 11. The cover surface 10 is formed here as a flat layer and further forms a guide 19, which is substantially cylindrical in this case and which surrounds the mouthpiece 7 in its upper region.

Figure 11:
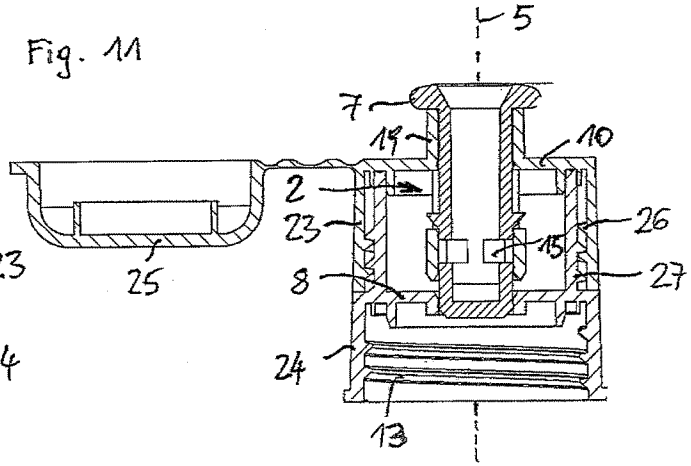
FIG. 11 shows a sectional view of the closure cap of FIG. 9 along the line of intersection A-A in FIG. 12 with closed mouthpiece.

Drinking can be carried out in the state of the closure cap in FIG. 10, but in the state of the closure cap in FIG. 11 the closure cap is sealed in a liquid-tight manner.

In order to insert a dispensing body into the closure cap or remove it therefrom, the closure elements 23 must be screwed off the base part 24, so that the receiving volume 20 is now accessible due to the now missing cover surface 10. The closure cap can be screwed onto a liquid container by means of the thread 13.

In order to ensure that the closure element 23 is not lost when being screwed off the base part 24, it can be additionally fixed to the base part 24 by means of a band for example.

LIST OF REFERENCE NUMERALS

1 Closure element (slide)
2 Entrance
3 Jacket surface of the closure cap
4 Sealing edge

5 Longitudinal axis of the closure cap
6 Profile rail
7 Mouthpiece
8 Receiving element
9 Opening in the receiving element
10 Cover surface
11 Spout opening
12 Ring
13 Thread
14 Baffle plate
15 Opening of the mouthpiece 7
16 Edge of the baffle plate 14
17 Guide in the bottom region of the mouthpiece 7
18 Edge of the closure cap
19 Guide in the upper region of the mouthpiece 7
20 Receiving volume
21 Depression in the sealing edge 4
22 Drinking opening of the mouthpiece 7
23 Closure element (can be screwed on)
24 Base part of the closure cap
25 Lid
26 Thread of the closure element 23
27 Thread for the closure element 23

The invention claimed is:

1. A closure cap for attaching to a liquid container, wherein the closure cap comprises a spout opening and a receiving volume for receiving at least one dispensing body, wherein the receiving volume comprises a receiving element, wherein the closure cap can be opened, thus forming an entrance to the receiving volume in order to enable introduction of the at least one dispensing body into the receiving volume or a removal of said dispensing body from the receiving volume, wherein the receiving element is permeable to a liquid in order to allow the at least one dispensing body to come into contact with the liquid, wherein a closure element connected to the closure cap is provided and via the closure element the entrance can be sealed in a liquid-tight manner or released, wherein a mouthpiece formed as a hollow body is arranged in the spout opening and seals the receiving element in a liquid-tight manner in a closed position, so that no liquid can flow through the receiving element into the receiving volume, and wherein the mouthpiece opens the receiving element in an open position, so that liquid can flow through the receiving element, the receiving volume, and the mouthpiece.

2. The closure cap according to claim 1, wherein the mouthpiece has a first side facing the receiving element and is sealed on the first side, so that in a closed state of the mouthpiece no liquid can reach the mouthpiece through the receiving element, wherein the mouthpiece comprises a protruding section protruding into the receiving volume, wherein the protruding section comprises at least one opening, and wherein through the at least one opening of the protruding section the liquid can flow from the receiving volume into the mouthpiece.

3. The closure cap according to claim 1, wherein the mouthpiece is displaceable along a sliding axis relative to the receiving element.

4. The closure cap according to claim 1, wherein a baffle plate is provided in the receiving volume and surrounds the mouthpiece at least in part, wherein the mouthpiece comprises an opening, wherein via the opening of the mouthpiece liquid can reach the mouthpiece from the receiving volume when the mouthpiece is situated in the open position, and wherein the baffle plate is located closer to the receiving element than to the opening of the mouthpiece.

5. The closure cap according to claim 1, wherein the mouthpiece is arranged at an edge of the receiving volume.

6. The closure cap according to claim 1, wherein the receiving element is formed as a flat surface.

7. The closure cap according to claim 1, wherein the closure element is formed as a part of a jacket surface of the closure cap, and wherein the closure element seals the entrance in an operating position.

8. The closure cap according to claim 1, comprising an extendable storage element for the dispensing body, wherein the extendable storage element corresponds to the entrance and the receiving volume and is introduced through the entrance into the receiving volume and can be placed on the receiving element.

9. The closure cap according to claim 1, wherein the closure element is formed as a slide displaceable along a jacket surface of the closure cap.

10. The closure cap according to claim 9, wherein the slide is displaceable in relation to the closure cap by using at least one profile rail.

11. The closure cap according to claim 9, wherein the slide surrounds an entire circumference of the closure cap.

12. The closure cap according to claim 11, wherein the slide is formed as a cylinder jacket.

13. The closure cap according to claim 9, further comprising sealing edges, wherein the slide latches in a closed state into the sealing edges, and wherein the sealing edges extend normally to a sliding axis of the slide.

14. The closure cap according to claim 9, further comprising sealing edges, wherein the slide is made of an elastic material so that the slide can be slid over the sealing edges, but seals the entrance in a liquid-tight manner after latching onto the sealing edges.

15. The closure cap according to claim 9, wherein a sliding axis of the slide and a sliding axis of the mouthpiece extend in parallel.

16. The closure cap according to claim 1, wherein the closure element can be screwed together via a thread with a base part of the closure cap.

17. The closure cap according to claim 16, wherein the closure element comprises the spout opening with the mouthpiece, while the base part comprises the receiving element.

* * * * *